United States Patent [19]

Herbert et al.

[11] 4,031,954

[45] June 28, 1977

[54] FLOW VALVE INSTALLATION AND REMOVAL APPARATUS

[75] Inventors: Gerald P. Herbert; Ferdinand M. McGinn; Hugh D. Embree, all of Lafayette, La.

[73] Assignee: Production Specialties, Inc., Lafayette, La.

[22] Filed: Sept. 13, 1976

[21] Appl. No.: 722,534

[52] U.S. Cl. ..... 166/117.5
[51] Int. Cl.² ..... E21B 23/00
[58] Field of Search ..... 166/117.5

[56] References Cited

UNITED STATES PATENTS

| | | | |
|---|---|---|---|
| 2,942,671 | 6/1960 | Schramm | 166/117.5 |
| 2,948,341 | 8/1960 | Fredd | 166/117.5 |
| 2,988,146 | 6/1961 | Fredd | 166/117.5 |
| 3,353,607 | 11/1967 | Kinley | 166/117.5 |
| 3,353,608 | 11/1967 | Beebe et al. | 166/117.5 |
| 3,827,490 | 8/1974 | Moore et al. | 166/117.5 |

*Primary Examiner*—James A. Leppink
*Attorney, Agent, or Firm*—Jack W. Hayden

[57] ABSTRACT

An apparatus for installing and removing flow valve in a well tubing having a plurality of valve receiving side pockets offset from the main bore of the tubing by providing an orientation sleeve with a first slot for directing a guide key of a valve handling apparatus in the sleeve and a second slot intersecting the first slot to assist in removal of debris from the first slot with spaced aligned shoulders in the sleeve at the intersection of the first and second slots for actuation of the valve handling apparatus. The valve handling apparatus includes a support body including an elongated cylindrical body member supporting a movable body comprising an elongated plunger telescopically and nonrotatably arranged in the support body. A guide key is pivotally connected to the support body with spring means yieldably urging it outwardly relative thereto so that the guide key can readily pass downwardly through any number of orientation sleeves but can engage with the first slot of the orientation sleeve immediately thereabove upon an upward movement of the valve handling apparatus in the well string to selectively install and remove a valve in or from any desired mandrel side pocket in the tubing string.

5 Claims, 5 Drawing Figures

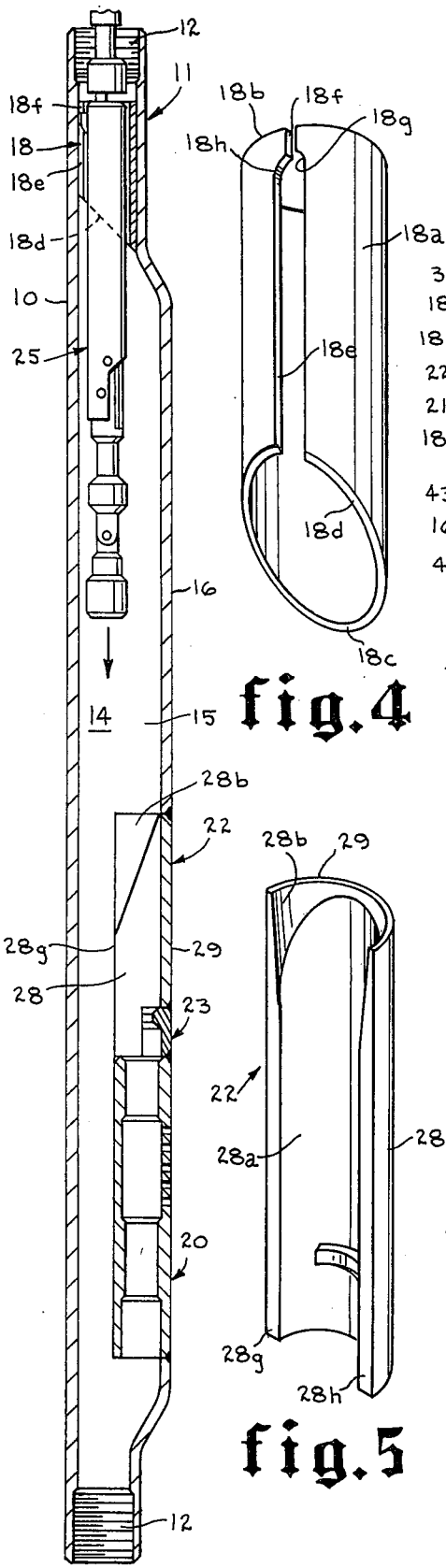
fig.4
fig.5
fig.1
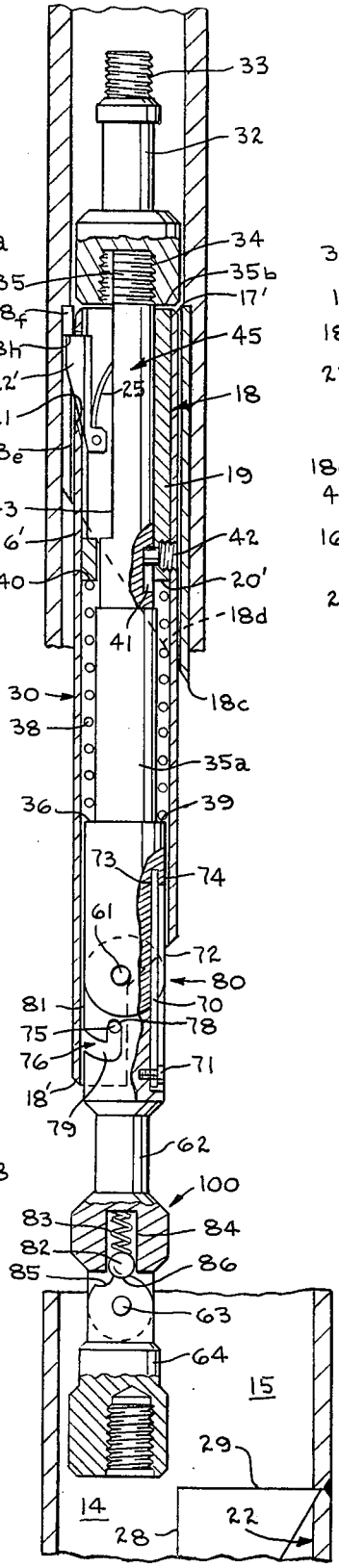
fig.2
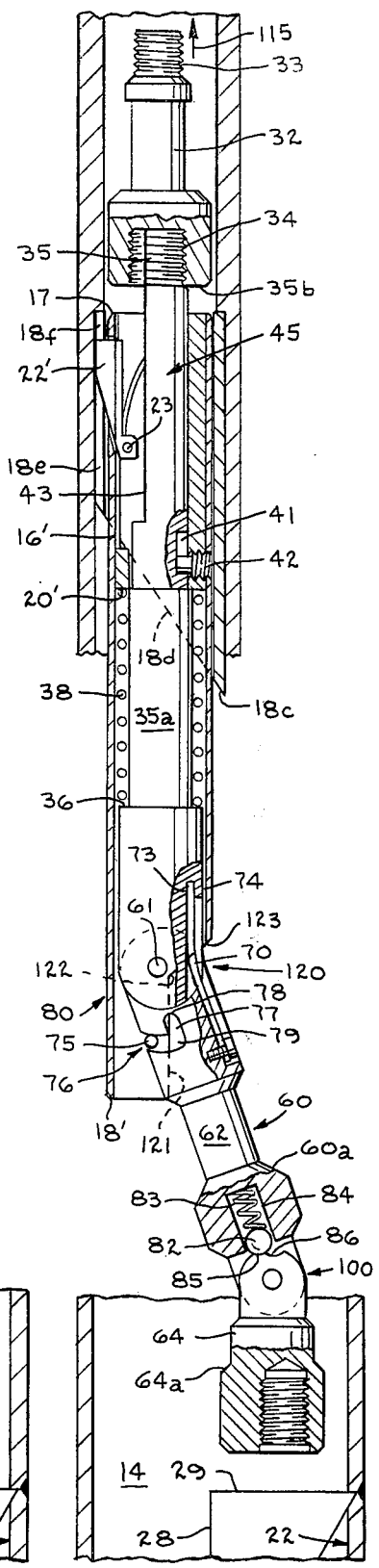
fig.3

FLOW VALVE INSTALLATION AND REMOVAL APPARATUS

SUMMARY OF THE INVENTION

The present invention relates to an apparatus for installing and/or removing flow valves and the like in a mandrel in a well tubing wherein a plurality of tubing mandrels are vertically spaced with means for orienting the valve handling apparatus with relation to the valve seat in the offset pocket of the mandrel, as well as guide means to selectively restrict access to the valve pocket. The present invention is an improvement over U.S. Patent Nos. 2,942,671; 2,988,146; 2,948,341; 3,827,490 and 3,353,608.

The present invention is directed to a well installation by providing improvements in an apparatus for installing and removing flow valves in a well tubing wherein a plurality of vertically spaced tubing mandrels are arranged and providing improved means for selectively actuating a valve handling apparatus in any one of the vertically positioned mandrels for orienting and aligning the valve handling apparatus with respect to the offset pocket of any one of the selected mandrels.

An object of the present invention is to provide a plurality of tubing mandrels each of which has an orienting sleeve mounted in the main bore of the tubing mandrel with a first longitudinally directed slot angularly spaced from the axis of the offset pocket with a second slot intersecting the first slot at one end thereof to provide a means for discharging debris and trash from the first slot so that a guide key of a valve handling apparatus may co-act with the first slot so as to move downwardly through any number of the orienting sleeves as the valve handling apparatus is lowered into the tubing, but which upon upward movement engages the first orienting sleeve and the first slot therein whereby the valve actuating apparatus may be actuated to align a valve with the offset pocket. A valve guide and guard is provided above the valve pocket to restrict access thereto except by flow valves of a predetermined size.

Other objects and advantages of the present invention will become apparent from a consideration of the description and drawings.

BRIEF DESCRIPTION OF THE DRAWINGS

FIG. 1 is a vertical sectional view of a mandrel for positioning in a tubing string illustrating the valve handling apparatus passing through an orienting sleeve arranged in the main bore at the upper end of a mandrel;

FIG. 2 is an enlarged section view of the orienting sleeve and valve handling apparatus;

FIG. 3 is a sectional view similar to FIG. 2 but illustrating the valve handling apparatus oriented and aligned for inserting a valve in the valve receiving pocket of the offset portion of the mandrel;

FIG. 4 is a perspective view of the orienting sleeve positioned at the upper end of each mandrel and aligned with the main bore therethrough; and FIG. 5 is a perspective view of the preferred form of the guide and guard arrangement.

DESCRIPTION OF THE PREFERRED EMBODIMENT

Attention is first directed to FIG. 1 of the drawings wherein a mandrel is referred to by the numeral 11 and is shown as including a tubular body 10 having threads 12 and 13 at each end thereof to enable the mandrel to be secured in a tubing string. The tubular body 10 provides a main bore 14 which aligns with the tubing string when it is secured in position therein and also includes on offset bore or pocket 15 formed by the bulge or laterally projecting and longitudinally extending enlargement 16 formed on the mandrel 11. On orienting sleeve 18 is arranged in the upper end of the mandrel and aligned with the main bore 14 and a valve receiving pocket 20 is formed in the offset pocket 15 with a guide and guard arrangement 22 thereabove for restricting access to the valve pocket 20. A projection means 23 between the guard and guide 20 and the valve pocket 20 enables the valve to be retained in position in the valve pocket 20 after it has been seated therein.

A valve handling apparatus is referred to generally at 25 and is adapted to be lowered through the tubing string along with a vale supported thereon (not shown). The valve handling apparatus 25 is constructed and arranged so that it may pass through any number of orienting sleeves 18 arranged in the mandrels 10 which mandrels 10 are provided at longitudinally spaced intervals within the tubing string. However, the valve handling apparatus 25 is also constructed and arranged so that when it is desired to insert the valve in a mandrel side pocket, this may be readily accomplished by pulling up on the cable or the well string which is used to lower the valve handling apparatus in the tubing string whereupon the valve handling apparatus engages with the orienting sleeve 18 immediately thereabove to align the valve handling apparatus and the valve supported thereby with the receiving pocket 20 for positioning the valve therein as will be described in greater detail.

The orienting sleeve 18 is illustrated in greater detail in FIG. 4 and includes an elongated hollow tubular body 18*a* having upper and lower ends 18*b* and 18*c*. The lower end 18*c* extends upwardly at an angle relative to the longitudinal axis of the tubular body 18*a* as illustrated at 18*d* to form a sloping guide surface which extends upwardly and away from the offset pocket 15 in the mandrel as shown in FIG. 1.

A first slot 18*e* extends longitudinally of the tubular body 18*a* from the highest portion of the guide surface 18*d* as shown in FIGS. 1 and 4 and terminates in spaced relation to the upper end 18*b* of the tubular body 18*a*. A second slot 18*f* intersects the end of the first slot 18*e* and extends to the upper end 18*b* of the body 18*a* to form a pair of spaced aligned shoulders 18*g* and 18*h* at the juncture of the first slot 18*e* and second slot 18*f*. This arrangement enables the valve handling apparatus 25 to be manipulated when the key 22′ thereon is engaged in the slot 18*e* so as to orient with the side pocket 15 and align with the valve receiving pocket 20, while at the same time enabling any debris or trash in the tubing string to flow upwardly through the slot 18*e* and the slot 18*f*, thus inhibiting a collection of such debris in the slot 18*e* which might impair the proper actuation of the valve handling apparatus in the well installation of the present invention.

Where the mandrels are used in a deviated well bore, it can be appreciated that the position of the offset 15 may in some instances be on the low side of the well, and even when the mandrels are not in a deviated string, other well tools which are passed through the tubing string may tend to move into the offset 15 and into the valve pocket 20.

In order to provide restricted access to the valve pocket 20 a combination guide and guard is provided in the offset extending upwardly above the valve pocket 20 such combination guide and guard being referred to generally by the numeral 22 and is shown as including a generally U shaped member of semicylindrical configuration with the base of the U at 29 forming part of the offset 16 of the mandrel 10. A pair of sides 28 and 28*a* extend inwardly from the base 29 and are spaced apart as better illustrated in FIG. 5. The sides 28 and 28*a* each include a vertial end surface 28*g* and 28*h* which face inwardly towards the main bore 14. The upper inner surface 28*b* of the combination guide and guard 22 is tapered upwardly and outwardly towards the upper end of the base 29, and the taper 28*b* along with the spaced sides 28, 28*a* with the vertial edges 28*g*, 28*h* which face inwardly towards the man bore 14 restrict access to the valve pocket 20 except by a flow valve of a predetermined size.

The valve handling apparatus is lowered into the well tubing as represented by the arrow 12 by any suitable means such as a wire line, cable or the like. It is shown in greater detail in FIGS. 2 and 3. It includes a support body comprising a cylindrical body member referred to generally at 30 having a movable body carried by and longitudinally movable relative thereto comprising an elongated plunger referred to generally at 45 telescopically and nonrotatably arranged in the body 30.

The cylindrical body member 30 includes the tubular housing 16′ which extends from its upper end 17′ to its lower end represented at 18′. A tubular insert 19 is provided adjacent the upper end 17′ of the tubular housing 16′ and provides a shoulder 20′ internally of the tubular housing 16′ as shown. A slot 21 is formed in the tubular housing 16′ and a guide key 22′ is pivotally mounted on the tubular housing 16′ by the shear pin 23 adjacent the lower end thereof. Spring means 25 in the form of a leaf spring engages the key 22′ and the plunger 45 to urge the key 22′ outwardly of the tubular housing 16′ as shown in FIG. 1 of the drawings.

The guide key 22′ projects outwardly through the slot 21 and outwardly of the tubular housing 16′ so that it can engage with the shoulders 18*g*, 18*h* of the orientation sleeve 18 which is positioned in the mandrel 11 and is aligned with the tubing and the main bore 14 of the mandrel 11 for a purpose as will be described in greater detail hereinafter. The elongated plunger 45 includes a cap 32 which is provided with a threaded upper end 33 for engagement with the running string and a threaded bore 34 for engaging with the threaded upper end 35 of the rod 35*a* as shown in the drawings. The cap 32 terminates at 35*b* which provides a shoulder for abutting the upper end 17′ of the tubular housing 16′ as the device is run into the well.

A shoulder 36 on the rod 35*a* of plunger means 45 is spaced from the shoulder 20′ formed on the tubular housing 16′ and a spring 38 has one end 39 resting on the shouler 36 and the other end 40 abutted against the shoulder 20′ so as to tend to urge the upper end 17′ of the tubular member 30 into engagement with the end 35 of the cap 32 forming the upper part of the plunger 45.

A slot 41 formed in the rod 35*a* of the plunger 45 receives the key or pin 42 which is secured in the tubular housing 16′ to accommodate longitudinal relative movement between the plunger 45 and tubular member 30 while inhibiting relative rotation therebetween. The elongated rod 35*a* of plunger means 45 is cut away as illustrated at 43 adjacent the guide key 22 so that after the pin 23 has been sheared, the guide key 22′ may be retracted internally of the tubular housing 16′ as the device is retrieved from the well tubing after a valve has been deposited in valve pocket 22.

The lower end 18′ of the tubular housing 16′ and its configuration is better illustrated in FIG. 3 of the drawings and is shown as including a cut away portion referred to generally at 120 which is defined by a line 121 extending longitudinally which terminates at 122 and intersects the outwardly tapering edge 123 of the cut away portion 120. This enables the shifting tool means referred to generally by the numeral 60 to move outwardly of the tubular housing 16′ and into the side pocket portion 15 of the mandrel 11 which is partially illustrated in FIG. 1 of the drawings.

Cooperating means referred to generally at 80 are provided on the plunger means 45 and the shifting tool means 60 to retain the plunger means 45 and shifting tool means 60 axially aligned in the main bore of the tubing string, which means are operable on movement of the plunger means 45 relative to the tubular housing 16′ for shifting of the shifting tool means 60 into the side pocket 22. The shifting tool means 60 is pivotally connected at 61 to the lower end of the plunger means 45 and includes a primary arm 62 which depends from the lower end of rod 35*a* of plunger means 45 as shown in FIG. 2 of the drawings. The primary arm 62 is pivotally connected at its lower end at 63 to the secondary arm 64 and cooperating spring loaded plunger and detent means referred to at 100 are provided between the primary arm 62 and secondary arm 64 for a purpose as will be described. The cooperating means 80 on the plunger means 45 and shifting tool means 60 includes the leaf spring means 70 secured by any suitable means such as the bolt 71 threaded through the lower end thereof and into primary arm 62 as shown. The leaf spring 70 is arranged in longitudinally extending recess 72 formed at the upper end of primary arm 62 and lower end of rod 35*a* of plunger means 45 and is of suitable width for receiving the leaf spring 70. It will be noted that the recess 72 is provided with an undercut portion 73 adjacent the upper end thereof to form an overhanging ledge 74 for retaining the upper end of the leaf spring engaged with the plunger.

A pin 75 shown as mounted adjacent the lower end 18′ of tubular housing 16′ and fits within the slot means referred to generally at 76. The slot means 76 is formed on the shifting tool means 60 and includes a vertically extending portion 77 having the closed upper end 78, such slot portion 77 intersecting at its lower end the laterally extending slot portion 79 which laterally extending slot extends outwardly and slightly upwardly to the edge 81 of the primary arm 62.

The spring loaded plunger and detent means 100 between the primary arm 62 and secondary arm 64 is formed by the ball 82 which is secured to the spring 83 received in recess 84 formed in the lower end of primary arm 62 as shown. A pair of detents 85 and 86 are formed in the upper end of secondary arm 64 for receiving the ball 82 therein.

When the tool is in the position as shown in FIGS. 1 and 2 of the drawings and is being lowered into the tubing string, the pin 75 is positioned in the vertical slot portion 77 having the closed end 78 and thus holds the plunger means 45 axially aligned with the shifting tool means 60. The leaf spring 70 tends to urge the shifting tool means 60 laterally relative to the longitudinal axis of the plunger means 45 as illustrated in FIG. 3 of the drawings; however, until an upward strain has been taken on the lowering string after the guide key 22′ is engaged with the shoulders 18*g*, 18*h* of the orientation sleeve 18 to pull the plunger means 45 upwardly relative to the upper end 17′ of the tubular housing 16′ as shown in FIG. 3 of the drawings, only then does the pin 75 and slot means 76 move relative to each other so that the pin 75 can assume a position to move into the laterally formed slot 79 as shown in FIG. 3 of the drawings. When the pin 75 is aligned with the laterally extending slot portion 79 at the lower end of slot portion 77 the leaf spring 70 then moves to its normally bent position as illustrated in FIG. 3 so as to cock or move the primary arm 62 laterally of the longitudinal axis of the plunger means 45 as shown in FIG. 3 of the drawings.

When this occurs the shifting tool 60 is moved into the side pocket portion 15 of the mandrel 11 as illustrated in FIG. 3 of the drawings and this moves lateral slot 79 to position it relative to pin 75 as shown in FIG. 3. Also, the secondary arm 64 engages the wall of the mandrel at the side pocket portion 15 and such engagement causes the secondary arm 64 to pivot about pivot 63 so that it in turn aligns with the valve pocket 22 of the mandrel 11 as shown in FIG. 3 of the drawings for placing a valve therein.

While it is believed that the operation of the present invention is apparent from the foregoing description, it will be assumed that the present invention has been lowered into a tubing string as shown in FIG. 1 of the drawings having an orientation sleeve 18 which has the caming surface 18*d* adjacent its lower end that communicates with a first longitudinally extending slot 18*e* in the sleeve 18. The orientation sleeve 18 is positioned in the tubing mandrels so that when the present invention is lowered into the tubing string and then the guide key 22′ engaged with the caming surface 18*e* of any mandrel and moved into the slot 18*c*, the shifting tool means 60 will be properly aligned relative to the valve pocket 22 for placing a valve therein. The guide key 22′ and caming surface 18*e* cooperate when engaged to rotate the present invention in the mandrel 11 to accomplish such alignment and by pulling up on the wire line or other arrangement which supports the present invention in the tubing string, the guide key 22′ is moved upwardly in the slot 18*e* until it engages the spaced shoulders 18*g*, 18*h* as shown in FIG. 3.

A further upward strain as represented by the arrow at 115 in FIG. 3 pulls the plunger means 45 upwardly while the cylindrical housing 16′ remains stationary thus moving the pin 75 down slot portion 77 whereupon the leaf spring 70 flexes and moves the shifting tool means 60 as illustrated in FIG. 3 of the drawings to move slot portion 79 relative to pin 75. As the primary arm 62 and secondary arm 64 shift towards the side pocket 15 the secondary arm 64 will engage the side of the mandrel 11 in the side pocket portion and will move the ball 82 from detent 86 to dentent 85. This helps maintain secondary arms 64 aligned with the valve pocket 22 as the tool is then lowered and the valve placed in the side pocket portion. The valve (not shown) is then positioned in the valve pocket 22 and the present invention disengaged therefrom by means well known in the art forming no part of the present invention.

After the valve has been seated, it is then desired to retrieve the present invention to the earth's surface. Further upward strain on the mechanism which supports the present invention in the tubing string with the key 22′ engaged in the slot 18*e* against the shoulders 18*g*, 18*h* shears pin 23 whereupon key 22′ may retract into the cylindrical housing 16′ as the present invention is moved upwardly through the well string. As the valve handling apparatus 25 is raised, the enlargement 60*a* on primary arm 62 reaches the smaller diameter of the tubing, relative to side pocket mandrel 11, and is forced inwardly to realign shifting tool means 60 and plunger means 45 and reposition pin 75 in alignment with slot portion 77. When the realignment occurs, the end 17′ of body 30 will reengage the end 35 of the plunger means 45 due to the force of spring 38. As the end 17′ moves towards the end 35 of the plunder the pin 75 will be moved upwardly in closed end slot portion 77 to reassume the position shown in FIG. 2 of the drawings. This will maintain axial alignment of the primary arm of the shifting tool means 60 with the plunger means 45 as continued upward movement of the present invention through the well string is effected. As the tool 25 is continued to be moved up in the tubing string, the enlargement 64*a* on the secondary arm 64 engages the tubing at its juncture with the mandrel 11 and this forces the secondary arm 64 to also axially align with the primary arm 62 so that the ball 82 then reengages in detent 86 and is thus locked in axial position for removal from the well bore.

From the foregoing invention, it can be seen that the present arrangement enables the valve handling apparatus forming part of the present invention to remain locked axially so that it can be lowered through the tubing string with a minimum of effort and then positioned adjacent a mandrel 11. As the tool is actuated as described hereinabove, it will be locked in alignment with the valve receiving section 22 in the side pocket 15 of the mandrel 11 to enable a valve to be deposited therein by means well known in the art.

Thereafter the present invention is manipulated as described hereinabove so that it relocks in axial alignment to enable it to be withdrawn from the tubing string, with a minimum of effort.

The lock lug 23 assists in maintaining the valve in position in valve pocket 22, but does not interfere with removal of the valve from valve pocket 22 when desired.

The foregoing disclosure and description of the invention are illustrative and explanatory thereof, and various changes in the size, shape, and materials as well as in the details of the illustrated construction may be made without departing from the spirit of the invention.

What is claimed is:

1. A well installation comprising:

a. a well tubing having a plurality of tubing mandrels each having a main bore therethrough with an orientation sleeve mounted in the main bore and a valve receiving side pocket offset from the main bore, said orientation sleeve including:

1. an elongated hollow tubular body having an upper and lower end;

2. said lower end extending upwardly at an angle relative to the longitudinal axis of said tubular body to form a sloping guide surface which extends upwardly and away from the offset pocket;

3. a first slot extending longitudinally of said tubular body from the highest portion of said guide surface, said first slot terminating in spaced relation to said upper end of said tubular body;
4. a second slot extending from the upper end of said first slot to the upper end of said tubular body; and
5. said second slot being substantially smaller in width than said first slot to form a pair of aligned shoulders at the juncture of said first and second slot which are spaced from each other by said second slot whereby debris may discharge from said first slot through said second slot and into the tubing;

b. guard and guide means above the valve receiving side pocket and including spaced sides facing the main bore and having vertical edge surfaces and an inner upwardly tapered end to guide a valve into the valve receiving side pocket;
c. a support body adapted to be moved through the tubing mandrels;
d. a movable body carried by and longitudinally movable relative to the support body;
e. a longitudinal guide key having an upwardly directed shoulder and an inclined surface facing downwardly, pivotally carried by said movable body for outward movement from said movable body and movable downwardly through said sleeves but an upward movement of said movable body engagable with the lower end of any sleeve immediately thereabove to slide along said first slot means and engage said aligned shoulders;
f. shifting tool means pivotally supported from said support body and adapted to support a valve handling support;
g. cooperating releasing means on said support body and movable plunger initially holding said shifting tool means aligned in the main bore; and
h. cooperating shifting means connected between said shifting tool means and said support body for shifting said shifting tool means into the side pocket when the releasing means is actuated.

2. The invention of claim 1 wherein:

a. said support body comprises an elongated cylindrical body member;
b. said movable body comprises an elongated plunger telescopically and nonrotatably arranged in said cylindrical body; and
c. said cooperating release means includes:
1. cooperating pin and slot means on said body member and plunger to maintain said plunger and body member axially aligned when said plunger and body member are in abutting relationship, said pin and slot movable relative to each other when said plunger is moved relative to said body member; and
2. additional spring means acting between said plunger and shifting tool means for shifting said shifting tool means into the side pocket when said pin and slot are in a predetermined relative position.

3. The invention of claim 2 wherein said shifting tool means includes:

a. a primary arm pivotally supported at one end by said plunger means;
b. a secondary arm pivotally supported at the other end of said primary arm; and
c. cooperating spring loaded plunger means and detent means on said primary and secondary arm to retain said primary and secondary arm aligned in the main bore and to retain said secondary arm aligned with the side pocket when said shifting tool means is shifted into the side pocket, said cooperating means and cooperating spring loaded plunger and detent means aligning said shifting tool means and plunger when said shear pin holding said guide key against the shoulder in the orientation sleeve is sheared and the apparatus is moved from the mandrel into the tubing.

4. The invention of claim 3 wherein:

a. said pin is mounted on said cylindrical body member;
b. said slot means is formed on said shifting tool means and includes a vertical portion having a closed end and a laterally extending portion one end of which intersects said vertical portion and the other end of which is open; and
c. said additional spring means is a leaf spring having one end secured to said shifting tool means and the other end engaged with said plunger, said spring normally tending to urge said shifting tool out of axial alignment with said plunger.

5. The invention of claim 1 wherein said shifting tool means includes:

a. a primary arm pivotally supported at one end by said plunger means;
b. a secondary arm pivotally supported at the other end of said primary arm; and
c. cooperating spring loaded plunger means and detent means on said primary and secondary arm to retain said primary and secondary arm aligned in the main bore and to retain said secondary arm aligned with the side pocket when said shifting tool means is shifted into the side pocket.

* * * * *

UNITED STATES PATENT AND TRADEMARK OFFICE

CERTIFICATE OF CORRECTION

PATENT NO. : 4,031,954

DATED : June 28, 1977

INVENTOR(S) : Gerald P. Hebert and Ferdinand M. McGinn and Hugh D. Embree

It is certified that error appears in the above-identified patent and that said Letters Patent are hereby corrected as shown below:

Col. 3, line 60, "shouler" should be --shoulder--.

Col. 7, line 21, after "tubing" insert --and--.

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*